US012605025B2

(12) United States Patent
Waid-Jones et al.

(10) Patent No.: US 12,605,025 B2
(45) Date of Patent: Apr. 21, 2026

(54) SYSTEM AND METHOD FOR DETECTING WALLS OR OBJECTS WITHIN A SPECIFIC PROXIMITY OF A VACUUM FLOOR NOZZLE

(71) Applicant: SHARKNINJA OPERATING LLC, Needham, MA (US)

(72) Inventors: Austin Waid-Jones, Danvers, MA (US); Casey McClay, Medford, MA (US); Nikola Petrov, Boston, MA (US); Zi Chan, Lancaster, MA (US); Zigui Huang, Suzhou (CN); Yiming Lu, Suzhou (CN); Jianshu Sun, Suzhou (CN); Baolin Chen, Suzhou (CN); Baoquan Yang, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 374 days.

(21) Appl. No.: 18/205,368

(22) Filed: Jun. 2, 2023

(65) Prior Publication Data

US 2024/0349966 A1 Oct. 24, 2024

Related U.S. Application Data

(63) Continuation of application No. PCT/CN2023/089388, filed on Apr. 20, 2023.

(51) Int. Cl.
*A47L 9/28* (2006.01)
*A47L 9/30* (2006.01)

(52) U.S. Cl.
CPC ..... *A47L 9/281* (2013.01); *A47L 9/2842* (2013.01); *A47L 9/30* (2013.01)

(58) Field of Classification Search
CPC ..... A47L 9/281; A47L 9/2842; A47L 9/30
See application file for complete search history.

(56) References Cited

U.S. PATENT DOCUMENTS

2013/0058635 A1 3/2013 Vrdoljak
2013/0152337 A1 6/2013 Thorne
(Continued)

FOREIGN PATENT DOCUMENTS

CN 208563212 3/2019
CN 208563212 U * 3/2019
(Continued)

OTHER PUBLICATIONS

WO-2022181878-A1—English Machine Translation (Year: 2022).*
(Continued)

*Primary Examiner* — Marc Carlson
(74) *Attorney, Agent, or Firm* — Grossman Tucker Perreault & Pfleger, PLLC

(57) ABSTRACT

A vacuum cleaner may include a suction motor; one or more edge detect sensors; a headlight assembly; one or more light sensors; and a controller. The controller is configured to: determine whether the vacuum cleaner is within a predetermined distance of a vertical surface based on an input received from the one or more edge detect sensors; responsive to determining that the vacuum cleaner is within the predetermined distance of the vertical surface, increase a suction power of the suction motor to a predetermined value; determine an ambient light level in an environment of the vacuum; and adjust an intensity of the headlight assembly based on the ambient light level in the environment.

20 Claims, 14 Drawing Sheets

(56) References Cited

U.S. PATENT DOCUMENTS

2014/0150201 A1 6/2014 Mcgee et al.
2015/0013102 A1 1/2015 Bilger
2015/0040340 A1 2/2015 Bilger et al.
2015/0135474 A1 5/2015 Gidwell
2015/0297054 A1 10/2015 Weeks et al.
2015/0351596 A1 12/2015 Thorne
2016/0128530 A1 5/2016 Thorne et al.
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0099051 A1* 4/2019 Hird ..... A47L 9/02
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1* 5/2020 Sutter ..... G02B 6/0083
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1 11/2020 Innes et al.
2020/0367711 A1 11/2020 Thorne et al.
2020/0371526 A1 11/2020 Kamada
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0059495 A1 3/2021 Gill et al.
2021/0085144 A1 3/2021 Woodrow et al.
2021/0169289 A1 6/2021 Thorne et al.
2021/0175772 A1 6/2021 Aini
2021/0177223 A1 6/2021 Der Marderosian et al.
2021/0186282 A1 6/2021 Mathieu et al.
2021/0204684 A1 7/2021 Heman-Ackah et al.
2021/0254615 A1 8/2021 Burbank
2021/0307581 A1 10/2021 Thorne et al.
2021/0315428 A1 10/2021 Udy et al.
2021/0386261 A1 12/2021 Woodrow et al.
2021/0386262 A1 12/2021 Uchendu et al.
2022/0031131 A1 2/2022 Mcclay et al.
2022/0031133 A1 2/2022 Der Marderosian et al.
2022/0031134 A1 2/2022 Yang et al.
2022/0061614 A1 3/2022 Yu et al.
2022/0071459 A1 3/2022 Gacin et al.
2022/0095864 A1 3/2022 Der Marderosian et al.
2022/0125256 A1 4/2022 Lessard et al.
2022/0287521 A1 9/2022 Cottrell et al.
2022/0322903 A1 10/2022 Lessard
2022/0400922 A1 12/2022 Mcclay et al.
2022/0408994 A1 12/2022 Hill
2023/0043567 A1 2/2023 Copeland et al.
2023/0070147 A1 3/2023 Harting et al.
2023/0157495 A1 5/2023 Copeland et al.
2023/0248192 A1 8/2023 Brown et al.
2023/0255423 A1* 8/2023 Camplani ..... A47L 9/2805 15/49.1
2023/0320550 A1 10/2023 Teuscher et al.
2023/0329499 A1* 10/2023 Lee ..... A47L 9/2826
2023/0329502 A1 10/2023 Chirikjian
2023/0329503 A1* 10/2023 Lee ..... A47L 5/26
2023/0355065 A1 11/2023 Finnegan
2023/0414052 A1 12/2023 Mcclay et al.
2024/0008699 A1 1/2024 Innes et al.
2024/0008703 A1* 1/2024 So ..... A47L 11/4088
2024/0065506 A1* 2/2024 Lee ..... A47L 9/0477
2024/0349966 A1* 10/2024 Waid-Jones ..... A47L 9/281
2024/0415352 A1 12/2024 Mcclay et al.

FOREIGN PATENT DOCUMENTS

CN 113509100 10/2021
CN 113509100 A * 10/2021 ..... A47L 9/2826
DE 102017112741 12/2018
DE 102017112741 A1 * 12/2018 ..... A47L 9/2826
KR 102392550 4/2022
KR 102392550 B1 * 4/2022 ..... A47L 9/2842
WO WO-2004041056 A1 * 5/2004 ..... A47L 9/2884
WO 2022008865 1/2022
WO WO-2022181878 A1 * 9/2022 ..... A47L 9/2836

OTHER PUBLICATIONS

PCT Search Report and Written Opinion issued Jan. 17, 2024, received in corresponding PCT Application No. PCT/CN23/89388, 9 pages.

* cited by examiner

| | Mode | BLDC Command | Nozzle Command | Motor Power (W) | Nozzle Power (W) | Nozzle RPM |
|---|---|---|---|---|---|---|
| 1002 | LOW HV | 0x51 | | 55 | 0 | 0 |
| | CleanSense LOW-1 HV | 0x51 | | 55 | 0 | 0 |
| | CleanSense LOW-2 HV | 0x52 | | 70 | 0 | 0 |
| | CleanSense LOW-3 HV | 0x53 | | 80 | 0 | 0 |
| | CleanSense MED-1 HV | 0x54 | | 95 | 0 | 0 |
| | CleanSense MED-2 HV | 0x55 | | 110 | 0 | 0 |
| | CleanSense MED-3 HV | 0x56 | | 150 | 0 | 0 |
| | CleanSense MAX-1 HV | 0x57 | | 160 | 0 | 0 |
| | CleanSense MAX-2 HV | 0x58 | | 170 | 0 | 0 |
| | CleanSense MAX-3 HV | 0x59 | | 181 | 0 | 0 |
| 1004 | MAX HV | 0x59 | | 181 | 0 | 0 |
| 1006 | LOW w/ Nozzle | 0x61 | 0x81 | 58 | 30 | 1300±300 |
| | CleanSense LOW-1 w/ Nozzle | 0x61 | | 58 | | |
| | CleanSense LOW-2 w/ Nozzle | 0x62 | | 65 | | |
| | CleanSense LOW-3 w/ Nozzle | 0x63 | | 72 | | |
| | CleanSense MED-1 w/ Nozzle | 0x64 | | 80 | | |
| | CleanSense MED-2 w/ Nozzle | 0x65 | 0x85 | 88 | BF: 30<br>Carpet: 60 | BF: 1300±300<br>Carpet: 2800±300 |
| | CleanSense MED-3 w/ Nozzle | 0x66 | | 96 | | |
| | CleanSense MAX-1 w/ Nozzle | 0x67 | | 104 | | |
| | CleanSense MAX-2 w/ Nozzle | 0x68 | | 112 | | |
| | CleanSense MAX-3 w/ Nozzle | 0x69 | | 121 | | |
| 1008 | MAX w/ Nozzle | 0x69 | 0x89 | 121 | 60 | 2800±300 |

FIG. 10

SYSTEM AND METHOD FOR DETECTING WALLS OR OBJECTS WITHIN A SPECIFIC PROXIMITY OF A VACUUM FLOOR NOZZLE

CROSS REFERENCE TO RELATED APPLICATIONS

The present application is a continuation of PCT application PCT/CN2023/089388, filed Apr. 20, 2023, which is fully incorporated herein by reference.

TECHNICAL FIELD

The present disclosure is generally directed to a battery powered vacuum cleaner and more specifically to motor speed and lighting intensity control for a battery powered vacuum cleaner.

BACKGROUND

Surface treatment apparatuses are configured to be moved across a surface to be cleaned (e.g., a floor). While being moved across the surface to be cleaned, the surface treatment apparatus is configured to collect at least a portion of debris present on the surface to be cleaned. One example of a surface treatment apparatus is a vacuum cleaner. The vacuum cleaner includes an air inlet, a cleaner dust cup, and a cleaner suction motor configured to cause air to flow into the air inlet and through the cleaner dust cup. Many vacuum cleaners today are powered by batteries, which limits the usage of the vacuum before the batteries require recharging. It is possible to extend cleaning sessions by only using minimal required power in every cleaning environment.

BRIEF DESCRIPTION OF THE DRAWINGS

Reference should be made to the following detailed description which should be read in conjunction with the following figures, wherein like numerals represent like parts.

FIG. 10 is an illustrative example chart of power settings for the vacuum of FIGS. 2A-2C, consistent with embodiments of the present disclosure.

DETAILED DESCRIPTION

Figure 1:
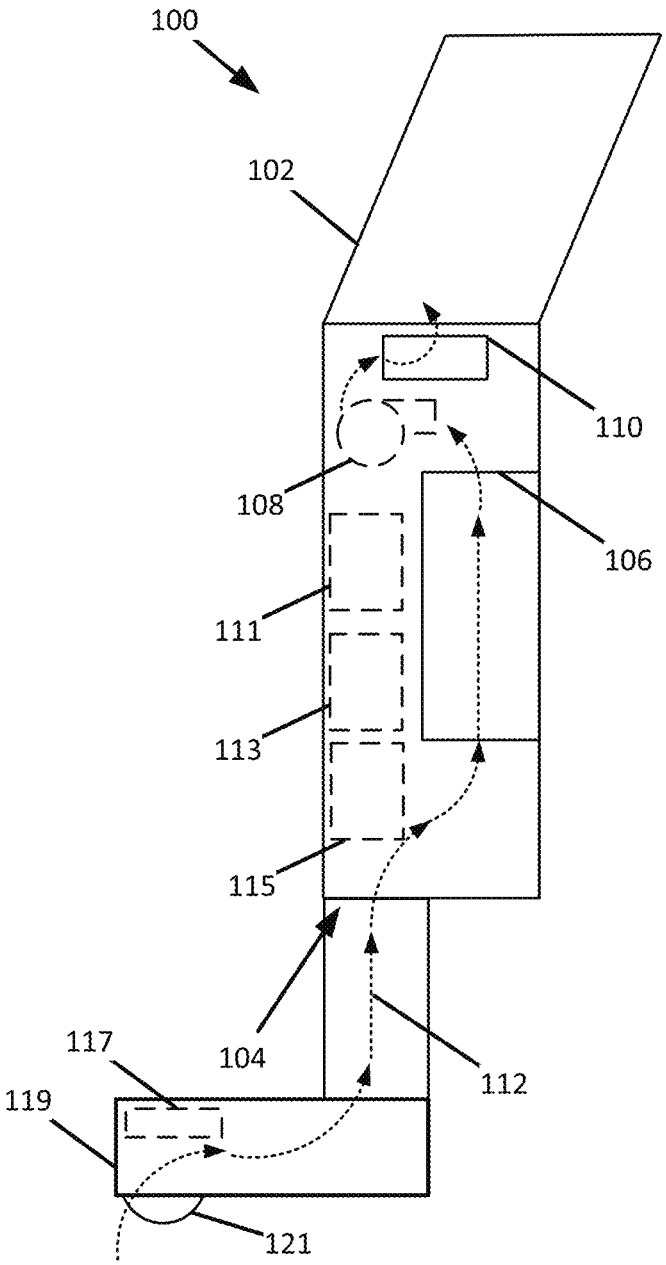
FIG. 1 shows a schematic example of a vacuum cleaner, consistent with embodiments of the present disclosure.

The present disclosure is not limited in its application to the details of construction and the arrangement of components set forth in the following description or illustrated in the drawings. The examples described herein may be capable of other embodiments and of being practiced or being carried out in various ways. Also, it may be appreciated that the phraseology and terminology used herein is for the purpose of description and should not be regarded as limiting as such may be understood by one of skill in the art. Throughout the present description, like reference characters may indicate like structure throughout the several views, and such structure need not be separately discussed. Furthermore, any particular feature(s) of a particular exemplary embodiment may be equally applied to any other exemplary embodiment(s) of this specification as suitable. In other words, features between the various exemplary embodiments described herein are interchangeable, and not exclusive.

Cordless vacuums may experience difficulty picking up debris on the side or front edges when adjacent to walls or large objects since they may have lower suction than corded vacuums. It may be beneficial to increase vacuum suction when a vertical surface is within a particular range of proximity to the nozzle, to overcome the disadvantage of limited battery power. Similarly, the vacuum suction may not remain at high levels to preserve battery power. To achieve this, it is may be beneficial for the vacuum nozzle to detect vertical surfaces within a particular range of proximity to the corresponding side or front edges.

The present disclosure is generally directed to motor speed and lighting intensity control for a cleaning system having a vacuum cleaner powered by one or more batteries. The vacuum cleaner includes a suction motor and a cleaner dust cup, the suction motor being configured to draw air into the cleaner dust cup such that at least a portion of debris entrained within the air is deposited within the cleaner dust cup. The vacuum cleaner may include one or more headlights to illuminate the surface being cleaned. Both the suction motor and the headlights draw current from the battery. As more current is drawn from the battery, the operating time before the battery requires recharging is decreased.

The use of infrared (IR) transmitters and receivers enables the vacuum circuitry to detect vertical surfaces within a specified range of proximity to the nozzle side or front edges. A vertical surface can be detected on either side of the nozzle with the IR sensor facing outward, perpendicular to the corresponding side. Alternatively, vertical surfaces can be detected on the front and a single side using the same IR sensor at a 45° angle with respect to the front and corresponding side.

Embodiments of the present disclosure may include a controller or control circuitry to perform the functions necessary to implement the features of the disclosure described herein.

Using photo detectors to measure ambient room light, headlights can be run on a fraction of power in bright environments and run full power in dim or dark environments. Similarly, using a nozzle motor controller to monitor power draw from the nozzle assembly, e.g., a brushroll, the controller may recognize the difference in power draw between bare floor and carpeted floor types to adjust from low to high revolutions per minute (RPM) when transitioning from bare floor to carpet and adjust from high to low RPM when transitioning from carpet to bare floor.

FIG. 1 shows a schematic example of a vacuum cleaner 100. The vacuum cleaner 100 includes a handle 102, an air inlet 104, a cleaner dust cup 106, a suction motor 108, a cleaner air exhaust 110, a controller 111, and a power supply (e.g., one or more batteries) 113 to power at least the suction motor 108 and/or the controller 111. In some instances, an accessory 119 having one or more rotating agitators (e.g., a brush roll) 121 may be removably coupled to the air inlet 104. As shown in FIG. 1, an inlet side of the suction motor 108 is fluidly coupled to the cleaner dust cup 106 and an outlet side of the suction motor 108 is fluidly coupled to the cleaner air exhaust 110. As such, when in the collection position, the suction motor 108 is configured to cause an airflow along a collection air path 112 that extends from the air inlet 104 through both the cleaner dust cup 106 and the suction motor 108 and out of the cleaner air exhaust 110, wherein air flows through the cleaner dust cup 106 before entering the suction motor 108. In other words, the cleaner dust cup 106 is upstream of the suction motor 108. When accessory 119 is coupled to the air inlet 104, the collection air path 112 may extend through the accessory 119 before passing through the air inlet 104.

The controller 111 may be configured to receive inputs from one or more sensors 115 (e.g., ambient light sensors, proximity sensors, debris detection sensors, floor type sensors, and/or any other sensor). In response to receiving inputs from the one or more sensors 115, the controller 111 may adjust a behavior of the vacuum cleaner 100. For example, when the one or more sensors 115 include an ambient light sensor, the controller 111 may be configured to adjust an intensity of a light source 117 (e.g., a light emitting diode) of the vacuum cleaner 100. By way of further example, when the one or more sensors 115 include a proximity sensor configured to detect a proximity of an object (e.g., a wall) to the air inlet 104 (and/or to the accessory 119 coupled to the air inlet 104), the controller 111 may be configured to adjust the suction motor 108 to either increase or decrease a quantity of suction generated based, at least in part, on the detected proximity. By way of still further example, when the one or more sensors 115 include a floor type sensor, the controller 111 may be configured to adjust a rotational speed of one or more agitators 121 of the accessory 119. In some instances, at least one of one or more sensors 115 may be configured to detect two more conditions. For example, at least one of one or more sensors 115 may be configured to detect both ambient light and proximity of an object.

Figure 2A:
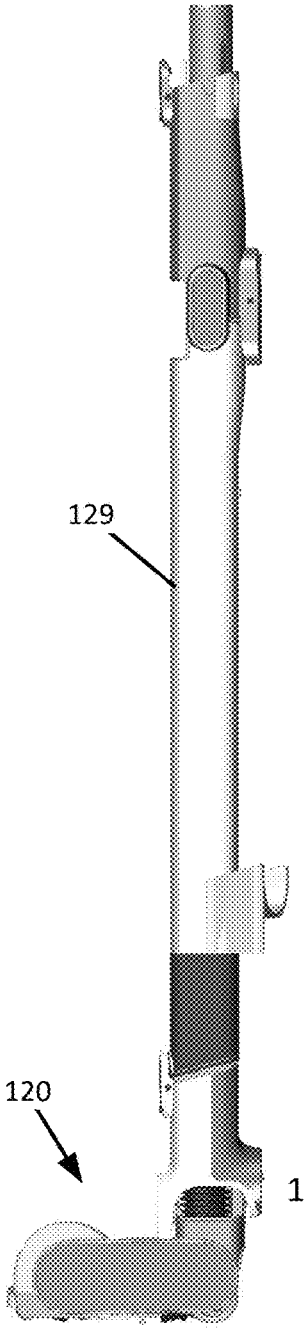
FIG. 2A is a left view of an example of an accessory of a battery powered vacuum cleaner, consistent with embodiments of the present disclosure.
Figure 2B:
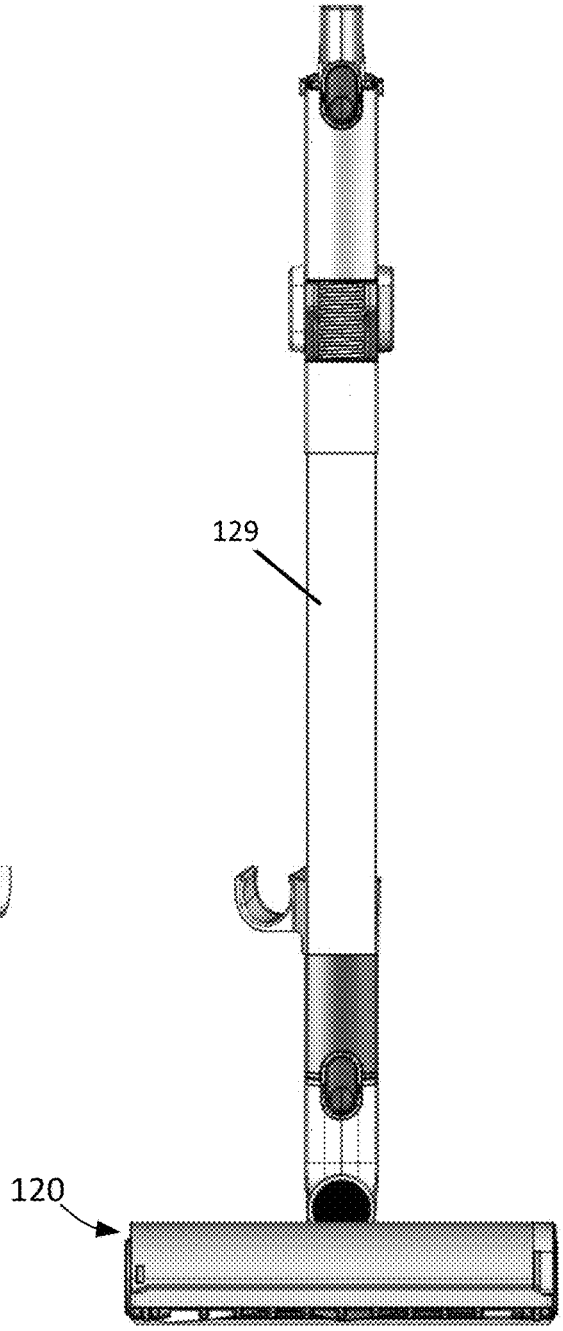
FIG. 2B is a front view of an example of the accessory of the battery powered vacuum cleaner, consistent with embodiments of the present disclosure.
Figure 2C:
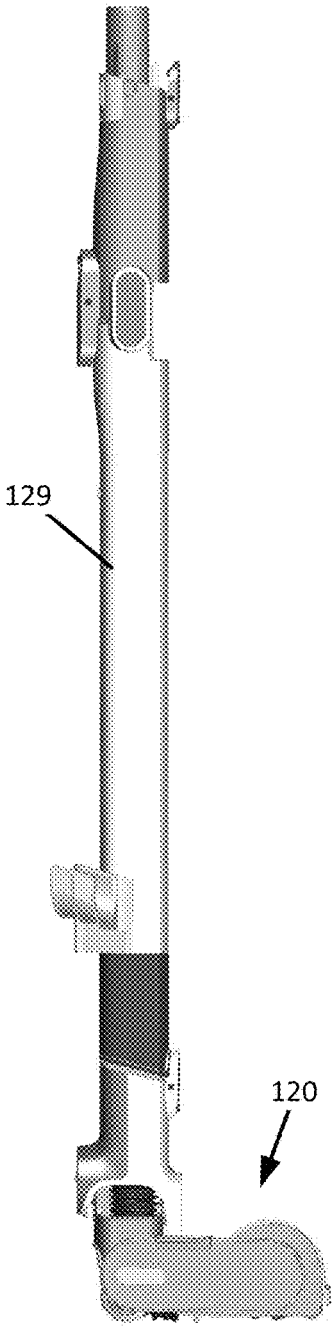
FIG. 2C is a right view of an example of the accessory of the battery powered vacuum cleaner, consistent right embodiments of the present disclosure.
Figure 2D:
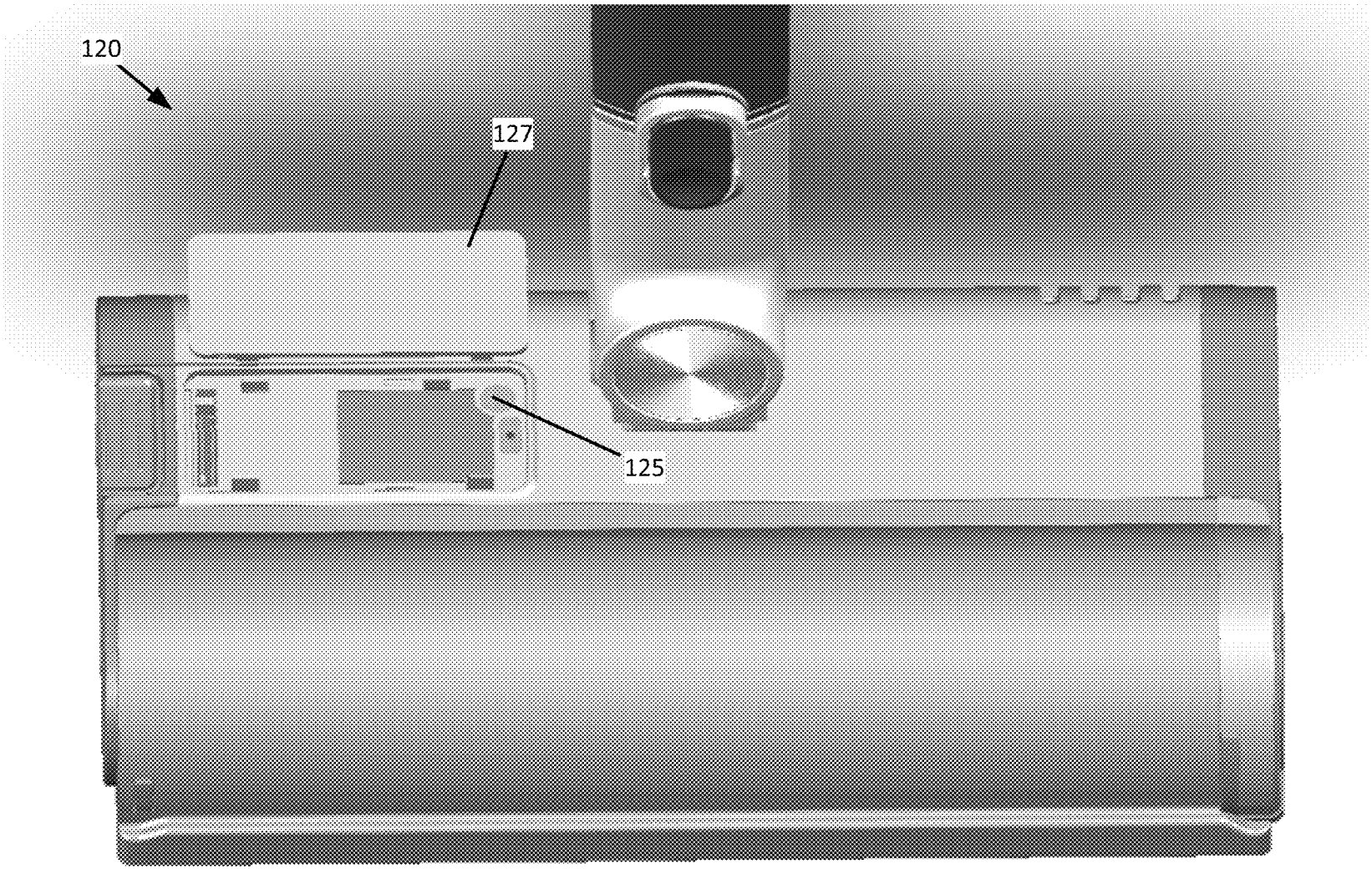
FIG. 2D is a perspective top view of an example of the accessory of the battery powered vacuum cleaner, consistent right embodiments of the present disclosure.

FIG. 2A is a left view, FIG. 2B is a front view, and FIG. 2C is a right view of an example of a wand 129 and a surface cleaning head assembly 120 configured to removably couple to vacuum cleaner 100 of FIG. 1, consistent with embodiments of the present disclosure. Wand 129 is configured to fluidly couple surface cleaning head assembly 120 to vacuum cleaner 100. In some instances, surface cleaning head assembly 120 may be configured to removably couple to vacuum cleaner 100 independent of wand 129 and/or wand 129 may be configured to removably couple to vacuum cleaner 100 independent of surface cleaning head assembly 120. Surface cleaning head assembly 120 may be, for example, a powered nozzle or a non-powered nozzle. Surface cleaning head assembly 120 and/or wand 129 are example(s) of accessory 119 of FIG. 1. FIG. 2D shows an exploded top view of surface cleaning head assembly 120. As shown in FIG. 2D, surface cleaning head assembly 120 includes a light sensor (e.g., a photodiode) 125 configured to sense an intensity of ambient light within an environment (e.g., a room). Light sensor 125 may be disposed beneath an at least partially transparent cover 127.

Figure 3A:
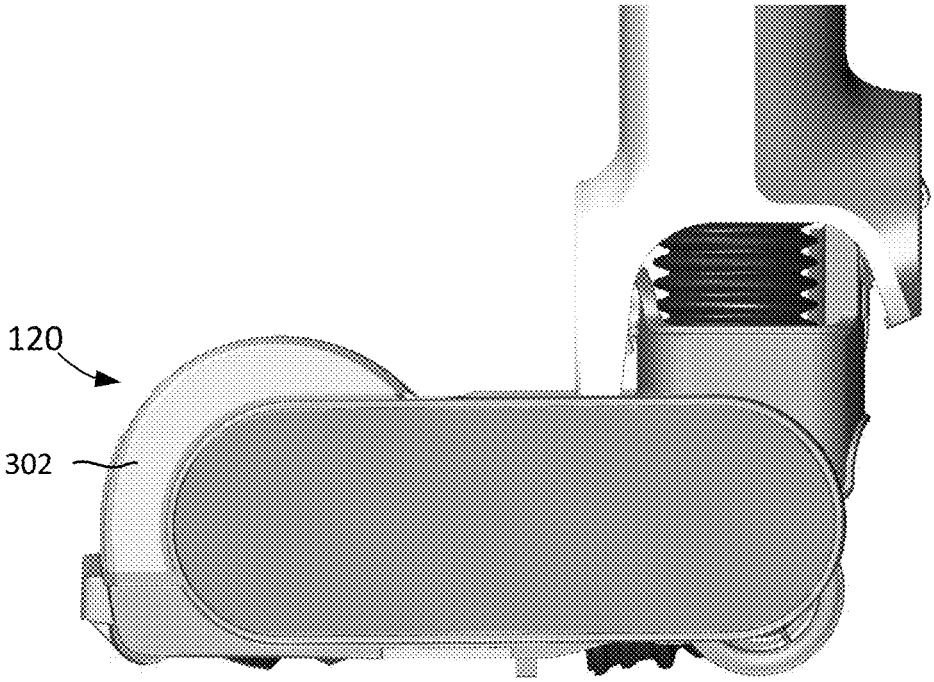
FIG. 3A is a closeup view of the left end of the surface cleaning head of an example of a battery powered vacuum cleaner, consistent with embodiments of the present disclosure.

FIG. 3A is a closeup view of the left end of the surface cleaning head assembly 120 of an example of a battery powered vacuum cleaner 100, consistent with embodiments of the present disclosure. The surface cleaning head assembly 120 includes left edge detector lens 302. In some embodiments, left edge detector lens 302 may be constructed of an IR-transparent material to allow for the transmission and reception of IR light by the left edge detect sensor module. In some embodiments, left edge detector lens 302 may be constructed of a silicon material with high electrical resistance.

Figure 3B:
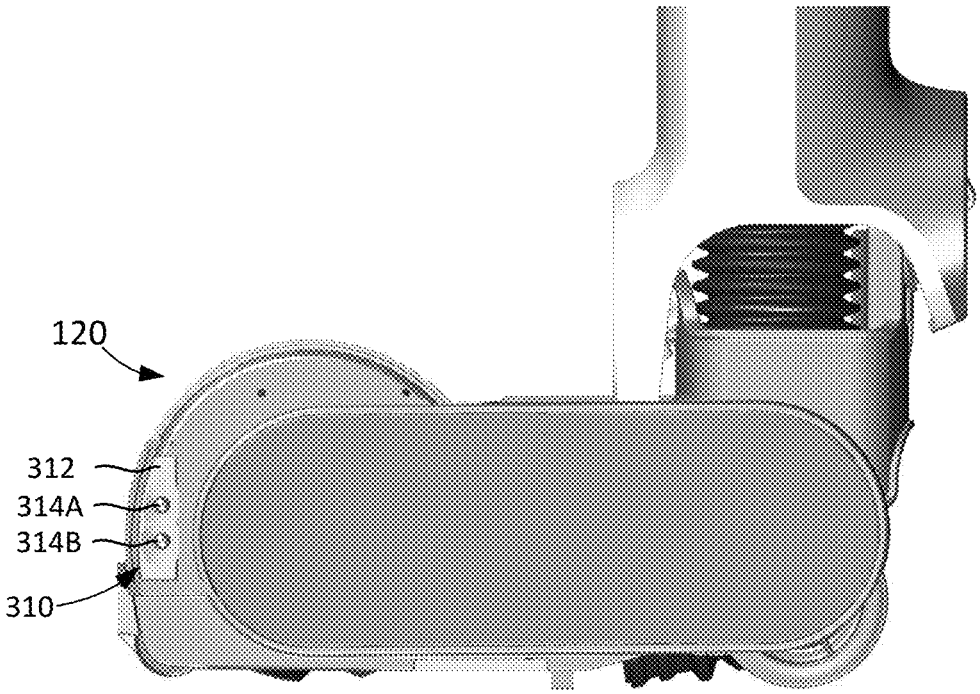
FIG. 3B is a closeup view of the left end of the surface cleaning head of FIG. 3A with the edge detector lens removed, consistent with embodiments of the present disclosure.

FIG. 3B is a closeup view of the left end of the surface cleaning head assembly 120 of FIG. 3A with the left edge detector lens 302 removed, exposing the left edge detector assembly 310. As shown, the left edge detector assembly 310 includes left shroud 312, IR emitter 314A, and IR receiver 314B. Although the example of FIG. 3B shows the IR emitter as part 314A and IR receiver as part 314B, the positions of the emitter and receiver may be reversed if so desired for performance and/or manufacturing reasons. Left shroud 312 may include an elastomeric material (e.g., a silicone, a rubber, and/or any other elastomeric material), which may absorb vibrations and/or encourage alignment of IR emitter 314A and/or IR receiver 314B.

In some embodiments, the emitter is an IR Light Emitting Diode (LED), and the detector is an IR photodiode that is sensitive to IR light of the same wavelength as that emitted by the IR LED. When IR light falls on the photodiode, the resistances and the output voltages will change in proportion to the magnitude of the IR light received. As the surface cleaning head assembly 120 moves closer to the vertical surface, the amount of IR light that reflects off the surface and is detected by the IR detector increases. When the output from the IR detector reaches a predetermined threshold, the controller will increase the power to the suction motor to increase the cleaning performance.

Figure 4C:
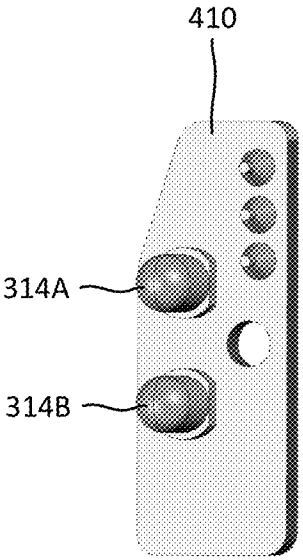
FIG. 4C is a perspective view of the left edge detector PCB assembly, consistent with embodiments of the present disclosure.
Figure 4B:
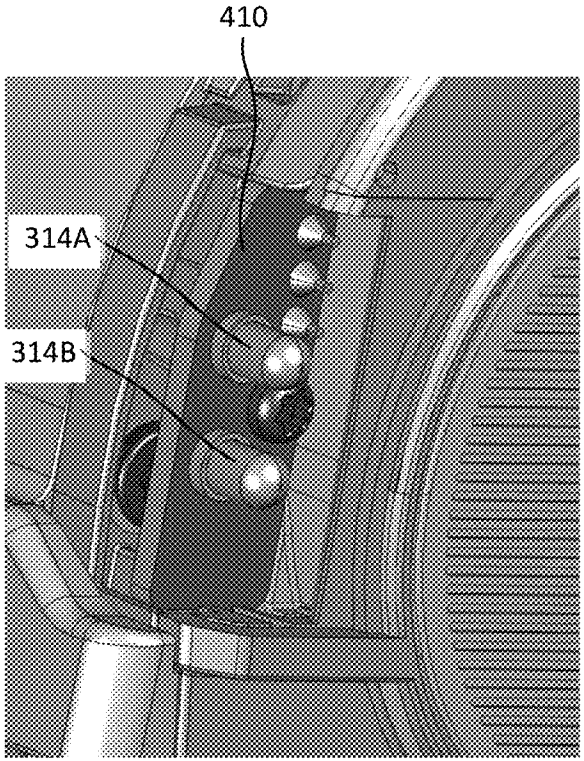
FIG. 4B is a closeup view of the left edge detector printed circuit board (PCB) assembly of the surface cleaning head of FIG. 3A, consistent with embodiments of the present disclosure.
Figure 4A:
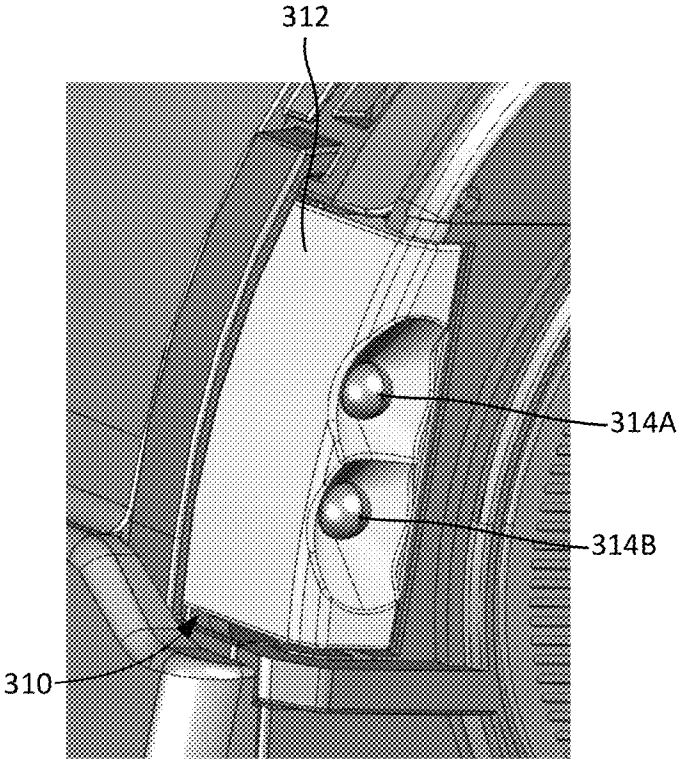
FIG. 4A is a closeup view of the left edge detector assembly of the surface cleaning head of FIG. 3A, consistent with embodiments of the present disclosure.

FIG. 4A is a closeup view of the left edge detector assembly 310 of the surface cleaning head assembly 120 of FIG. 3A, consistent with embodiments of the present disclosure. In the closeup of FIG. 4A, the left shroud 312, the IR emitter 314A, and the IR receiver 314B are more clearly shown. The left shroud 312 is configured to allow IR emissions from the IR emitter 314A to project to the left side of vacuum cleaner 100, while blocking the emissions in front of vacuum cleaner 100. In some embodiments, however, the left shroud 312 may be configured differently to allow, for example, some emissions to the front of vacuum cleaner 100.

FIG. 4B is a closeup view of the left edge detector assembly 310 of the surface cleaning head assembly 120 of FIG. 3A, with the left shroud 312 removed. With the left shroud 312 removed, the left edge detector assembly 310 is visible. The left edge detector assembly 310 includes IR emitter 314A and IR receiver 314B, mounted to left edge detector PCB 410.

FIG. 4C is a perspective view of the left edge detector assembly 310, showing IR emitter 314A and IR receiver 314B, mounted to left edge detector PCB 410.

Figure 5A:
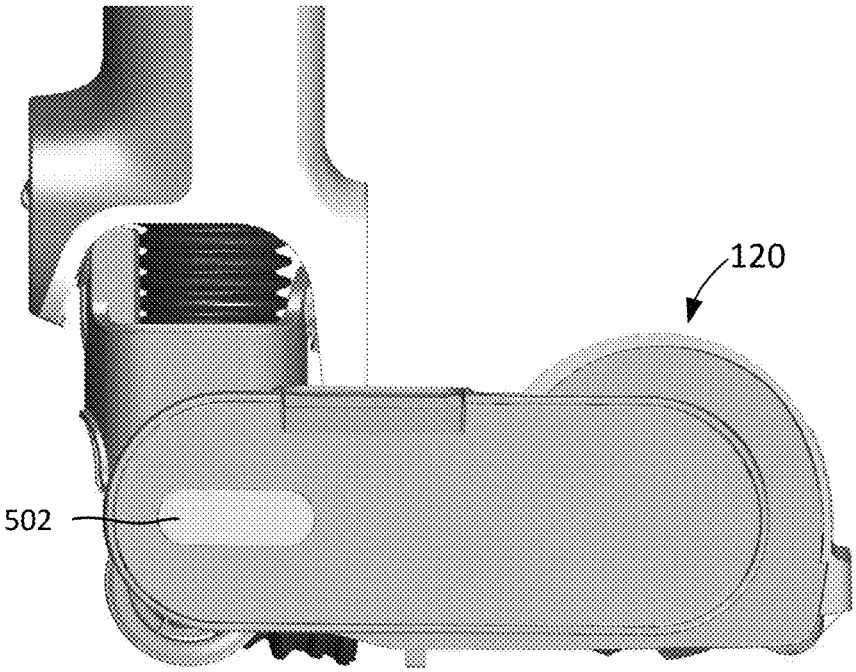
FIG. 5A is a closeup view of the right end of the surface cleaning head of an example of a battery powered vacuum cleaner, consistent with embodiments of the present disclosure.

FIG. 5A is a closeup view of the right end of the surface cleaning head assembly 120 of an example of a battery powered vacuum cleaner 100, consistent with embodiments of the present disclosure. FIG. 5A shows right edge detector lens 502. In some embodiments, right edge detector lens 502 may be constructed of an IR-transparent material to allow for the emission and reception of IR light by the right edge detect sensor module. In some embodiments, right edge detector lens 502 may be constructed of a silicon material with high electrical resistance.

Figure 5B:
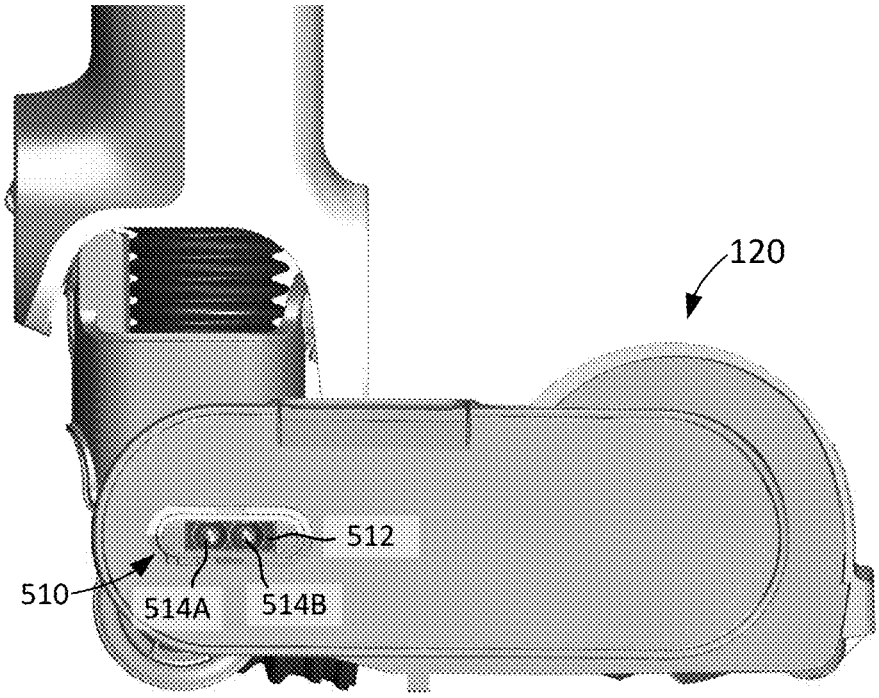
FIG. 5B is a closeup view of the right end of the surface cleaning head of FIG. 5A with the edge detector lens removed, consistent with embodiments of the present disclosure.

FIG. 5B is a closeup view of the right end of the surface cleaning head assembly 120 of FIG. 5A with the right edge detector lens 502 removed, exposing the right edge detector assembly 510. As shown, the right edge detector assembly 510 includes right shroud 512, IR emitter 514A, and IR receiver 514B. Although the example of FIG. 5B shows the IR emitter as part 514A and IR receiver as part 514B, the positions of the emitter and receiver may be reversed if so desired for performance and/or manufacturing reasons.

Figure 6A:
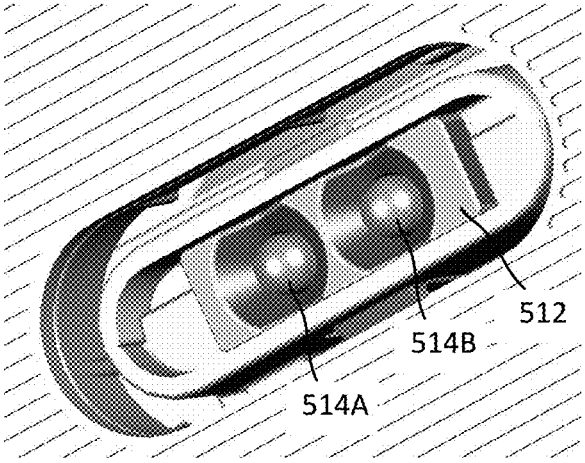
FIG. 6A is a closeup view of the right edge detector assembly of the surface cleaning head of FIG. 5A, consistent with embodiments of the present disclosure.

FIG. 6A is a closeup view of the right edge detector assembly of the surface cleaning head assembly 120 of FIG. 5A, consistent with embodiments of the present disclosure. In the closeup of FIG. 6A, the right shroud 512, IR emitter 514A, and IR receiver 514B are more clearly shown.

Figure 6B:
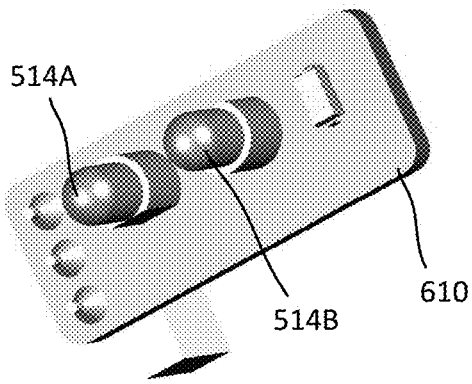
FIG. 6B is a perspective view of the right edge detector PCB assembly, consistent with embodiments of the present disclosure.

FIG. 6B is a perspective view of the right edge detector assembly 510 with the right shroud 512 removed, consistent with embodiments of the present disclosure. With the right shroud 512 removed, the right edge detector assembly 510 is visible. The right edge detector assembly 510 includes IR emitter 514A and IR receiver 514B, mounted to left edge detector PCB 610.

Figure 6C:
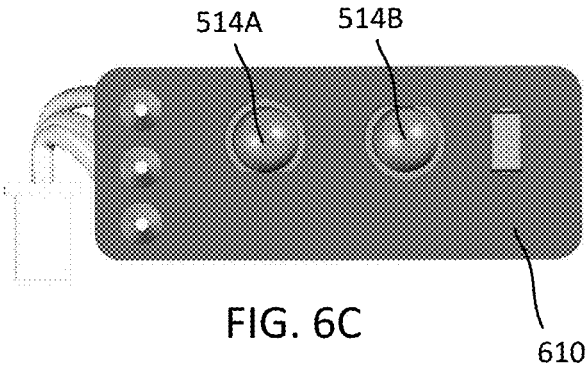
FIG. 6C is a top view of the right edge detector PCB assembly, consistent with embodiments of the present disclosure.

FIG. 6C is a top view of the right edge detector assembly 510, showing IR emitter 514A and IR receiver 514B, mounted to left edge detector PCB 610.

Figure 7A:
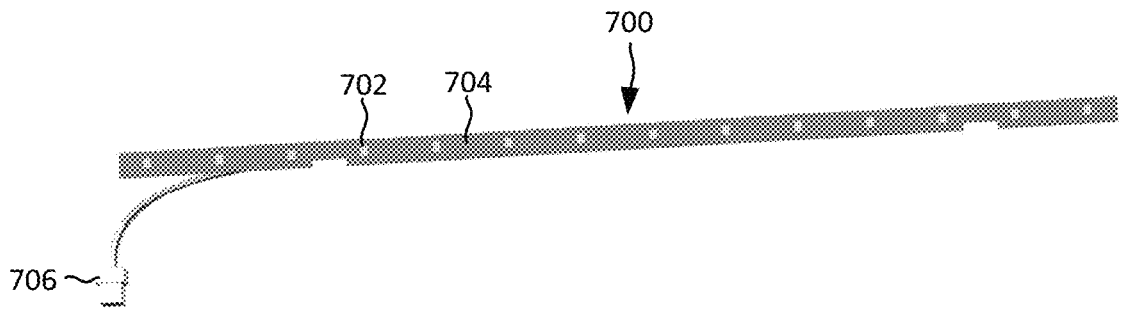
FIG. 7A is a perspective view of the headlight assembly PCB, consistent with embodiments of the present disclosure.

FIG. 7A is a perspective view of the headlight assembly 700, consistent with embodiments of the present disclosure. The headlight assembly 700 may contain a plurality of LEDs 702, e.g., white LEDs, mounted on headlight PCB 704. In some embodiments, the plurality of LEDs are divided into two or more groups of LEDs that may be controlled independently. This allows, for example, the ability to have different intensity of light on the left side of the surface cleaning head assembly 120 than on the right side of the surface cleaning head assembly 120. The headlight assembly 700 also includes headlight assembly connector 706 to couple headlight assembly 700 to the controller and/or the power supply. The headlight assembly 700 is mounted in the surface cleaning head assembly 120 as shown in FIG. 7B.

Figure 7B:
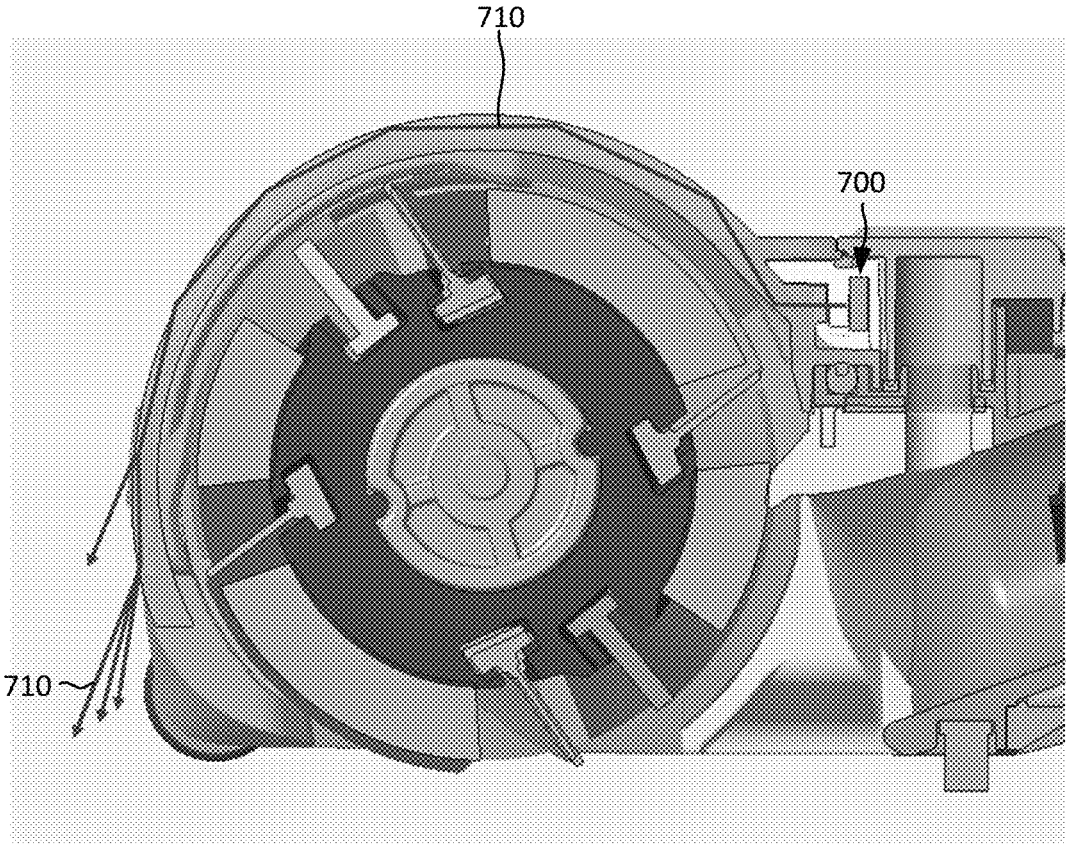
FIG. 7B is an illustration showing the light path for the headlight, consistent with embodiments of the present disclosure.

FIG. 7B is an illustration showing the light path 710 for the headlight, consistent with embodiments of the present disclosure. As shown in FIG. 7B and discussed above, the headlight assembly 700 is mounted in the surface cleaning head assembly 120, and the light is able to travel through the brushroll window of the surface cleaning head assembly 120.

Figure 8:
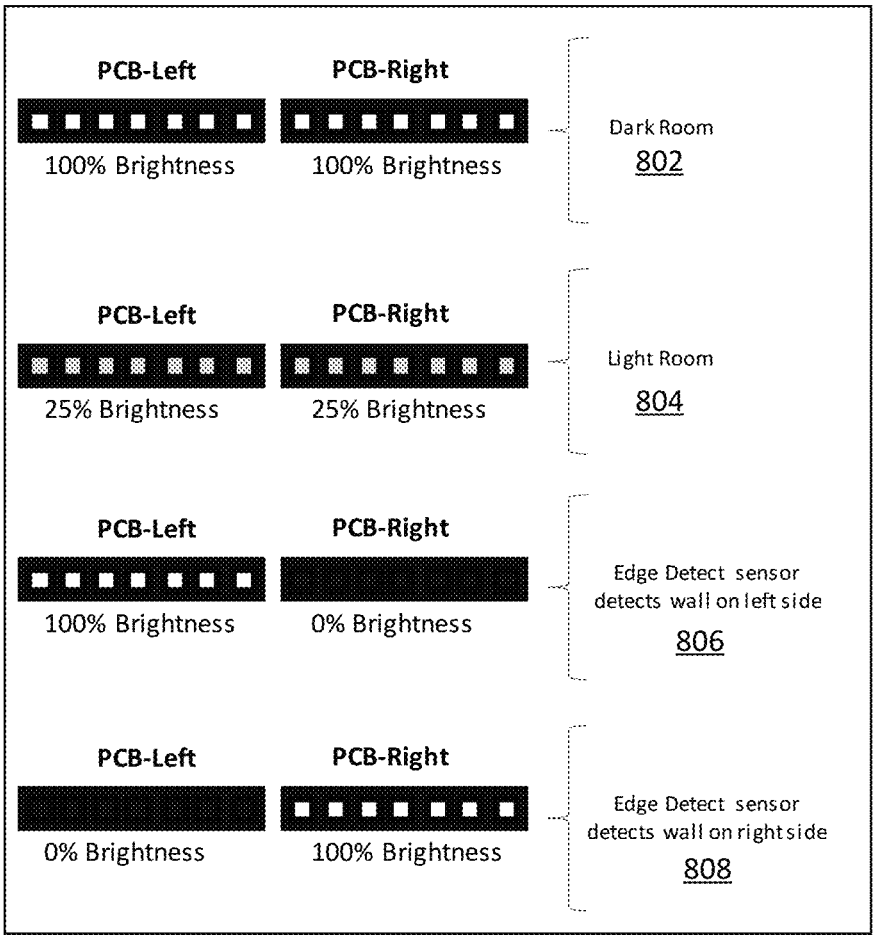
FIG. 8 is a diagram of one illustrative example brightness settings for the headlight of the vacuum of FIGS. 2A-2C, consistent with embodiments of the present disclosure.

FIG. 8 is a diagram of one illustrative example of brightness settings for the headlight of the vacuum cleaner 100 of FIGS. 2A-2C, consistent with embodiments of the present disclosure. In the following illustrative examples for FIG. 8 and FIGS. 9A-9E, the headlight assembly 700 is divided into two sections, a left section, and a right section, and the two sections are individually controlled. In the diagrams for FIG. 8 and FIGS. 9A-9E, the left section of the headlight assembly 700 is referenced as "PCB-Left" and the right section of the headlight assembly 700 is referenced as "PCB-Right." In the diagrams, the squares within each of "PCB-Left" and "PCB-Right" represent white LEDs.

In the diagram of FIG. 8, initially the edge detect sensors do not sense any walls, so in case 802 for a dark room (e.g., as detected by light sensor 125) both sections of headlight assembly 700 may be lit to 100% brightness, and in case 804 for a light room (e.g., as detected by light sensor 125) both sections of headlight assembly 700 may be lit to a lower intensity, e.g., 25% brightness. If a wall is detected on the left side of the vacuum cleaner 100 in case 806, then the left section may be lit to 100% brightness, and the right section may be lit to 0% brightness. If a wall is detected on the right side of the vacuum cleaner 100 in case 808, then the left section may be lit to 0% brightness, and the right section may be lit to 100% brightness.

Figure 9A:
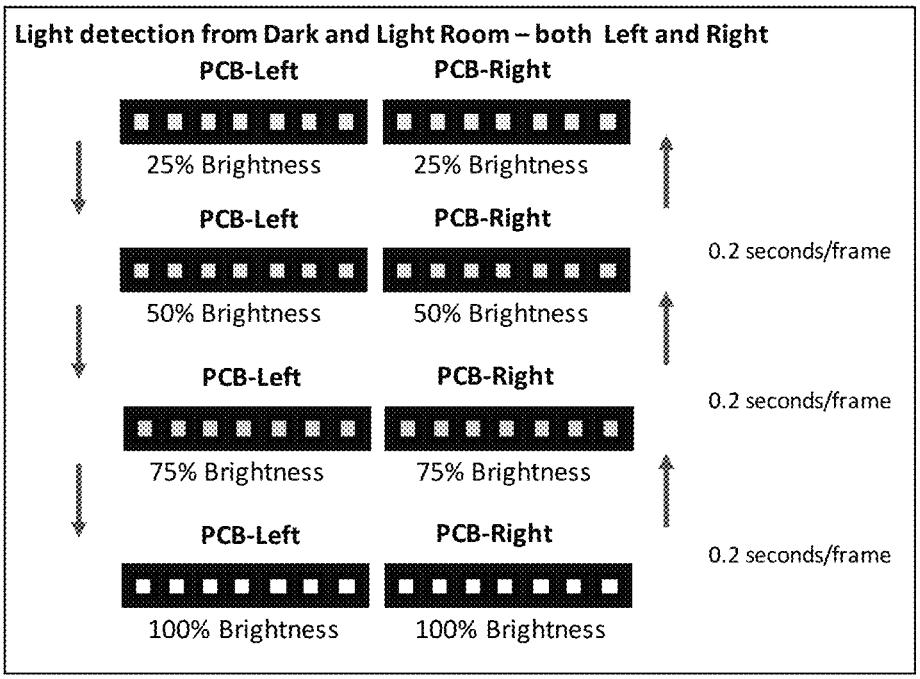
FIG. 9A is a diagram of one illustrative example brightness settings for the headlight of the vacuum of FIGS. 2A-2C, when light is detected both left and right transitioning from dark to light, and light to dark, consistent with embodiments of the present disclosure.

FIG. 9A is a diagram of one illustrative example of brightness settings for the headlight of the vacuum cleaner 100 of FIGS. 2A-2C, when light is transitioning from dark to light, and light to dark, consistent with embodiments of the present disclosure. In the diagram of FIG. 9A, the edge detect sensors do not sense any walls. Therefore, both sections of headlight assembly 700 are lit to the same intensity. The diagram of FIG. 9A shows a progression, from top to bottom, of a brightly lit room progressing to a dark room and, from bottom to top, a dark room progressing to a brightly lit room. As the room light increases, both sections of headlight assembly 700 decrease from a maximum intensity, e.g., 100% brightness, to a minimum intensity, e.g., 25% brightness. As the room light decreases, both sections of headlight assembly 700 increase from a minimum intensity, e.g., 25% brightness, to a maximum intensity, e.g., 100% brightness.

Figure 9B:
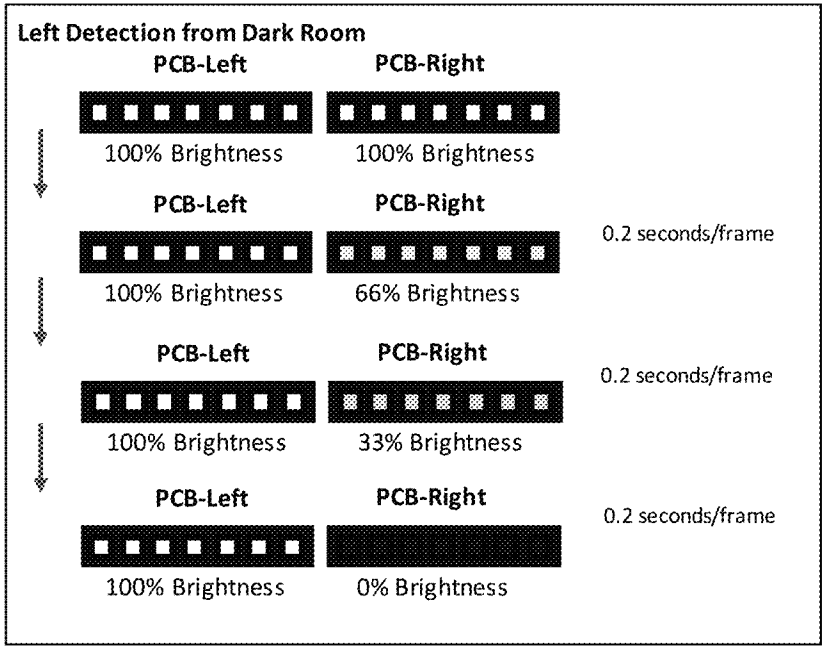
FIG. 9B is a diagram of one illustrative example brightness settings for the headlight of the vacuum of FIGS. 2A-2C, when light is detected from the left in a dark room, consistent with embodiments of the present disclosure.
Figure 9C:
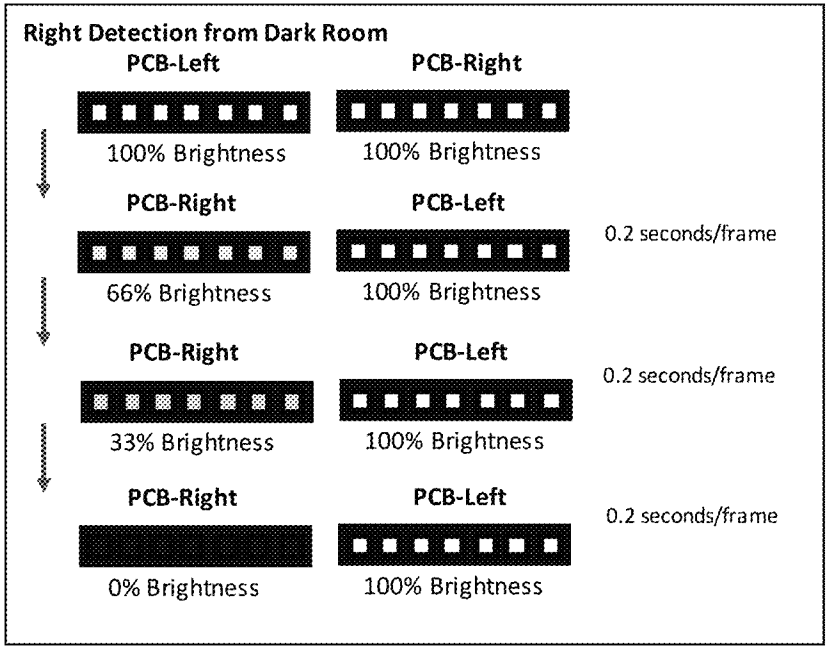
FIG. 9C is a diagram of one illustrative example brightness settings for the headlight of the vacuum of FIGS. 2A-2C, when light is detected from the right in a dark room, consistent with embodiments of the present disclosure.

FIG. 9B is a diagram of one illustrative example brightness settings for the headlight of the vacuum cleaner 100 of FIGS. 2A-2C, when an edge is detected from the left in a dark room, consistent with embodiments of the present disclosure. In the diagram of FIG. 9C, the left edge detect sensor detects a wall, and therefore, as the room lighting progresses from dark to light, the left section of headlight assembly 700 is lit to 100% intensity, while the right section of headlight assembly 700 progresses from 100% intensity down to minimum intensity, e.g., 0% intensity, as the brightness increases.

FIG. 9C is a diagram of one illustrative example brightness settings for the headlight of the vacuum cleaner 100 of FIGS. 2A-2C, when an edge is detected from the right in a dark room, consistent with embodiments of the present disclosure. In the diagram of FIG. 9C, the right edge detect sensor detects a wall, and therefore, as the room lighting progresses from dark to light, the right section of headlight assembly 700 is lit to 100% intensity, while the left section of headlight assembly 700 progresses from 100% intensity down to minimum intensity, e.g., 0% intensity, as the brightness increases.

Figure 9E:
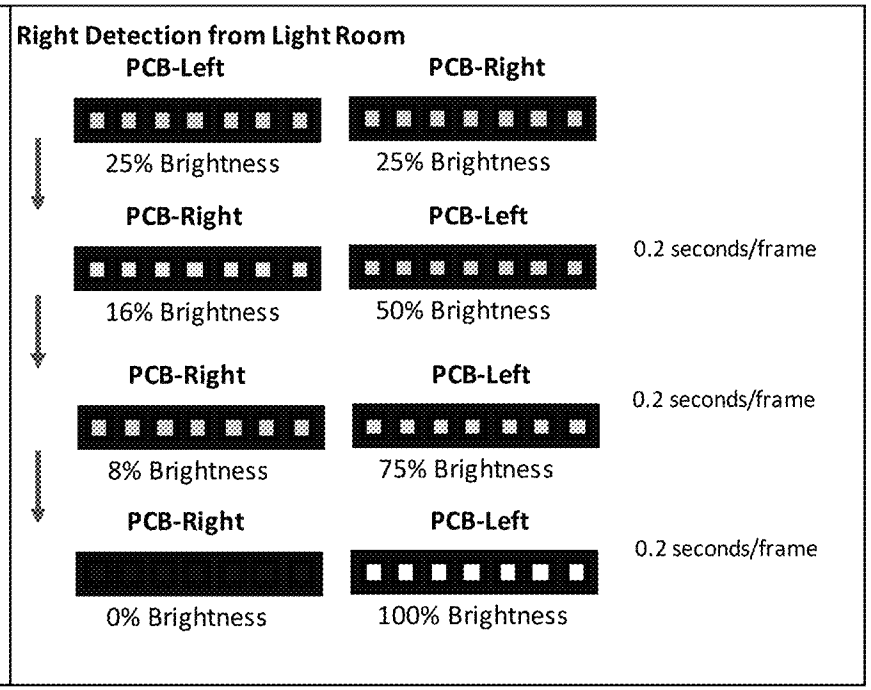
FIG. 9E is a diagram of one illustrative example brightness settings for the headlight of the vacuum of FIGS. 2A-2C, when light is detected from the right in a light room, consistent with embodiments of the present disclosure.
Figure 9D:
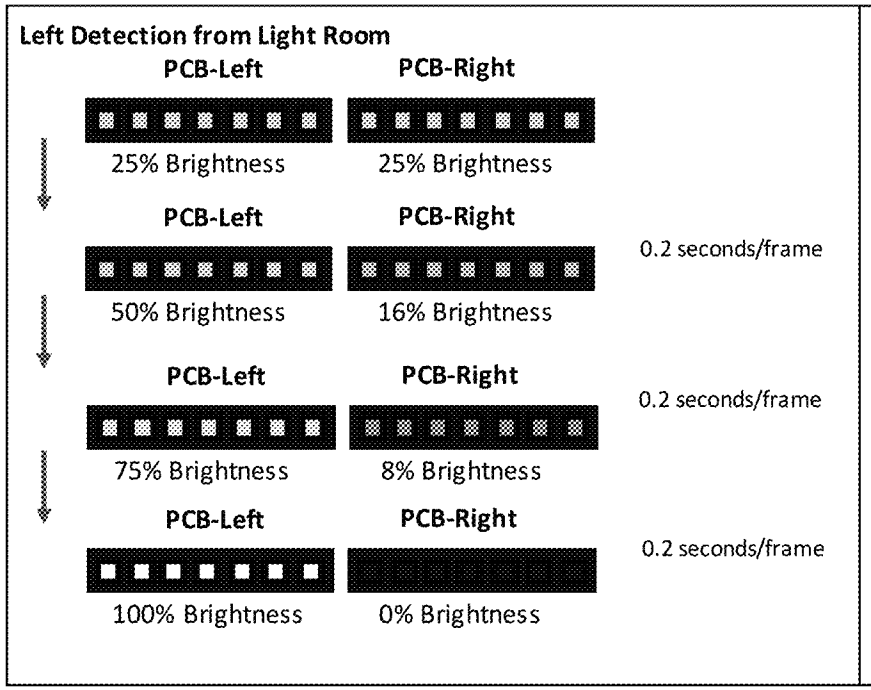
FIG. 9D is a diagram of one illustrative example brightness settings for the headlight of the vacuum of FIGS. 2A-2C, when light is detected from the left in a light room, consistent with embodiments of the present disclosure.

FIG. 9D is a diagram of one illustrative example brightness settings for the headlight of the vacuum cleaner 100 of FIGS. 2A-2C, when an edge is detected from the left in a light room, consistent with embodiments of the present disclosure. In the diagram of FIG. 9D, the left edge detect sensor detects a wall in a brightly lit room, and therefore, the left section of headlight assembly 700 progresses from low intensity, e.g., 25% intensity, up to 100% intensity, while the right section of headlight assembly 700 progresses from low intensity, e.g., 25% intensity, to 0% intensity.

FIG. 9E is a diagram of one illustrative example brightness settings for the headlight of the vacuum cleaner 100 of FIGS. 2A-2C, when an edge is detected from the right in a light room, consistent with embodiments of the present disclosure. In the diagram of FIG. 9E, the right edge detect sensor detects a wall in a brightly lit room, and therefore, the right section of headlight assembly 700 progresses from low intensity, e.g., 25% intensity, up to 100% intensity, while the left section of headlight assembly 700 progresses from low intensity, e.g., 25% intensity, to 0% intensity.

FIG. 10 is an illustrative example chart of power settings for the vacuum cleaner 100 of FIGS. 2A-2C, consistent with embodiments of the present disclosure. The illustrative example chart of FIG. 10 illustrates two different modes of the vacuum cleaner 100. In the upper half of the chart, from "LOW HV" 1002 to "MAX HV" 1004, the vacuum cleaner 100 uses a non-powered nozzle, and therefore the nozzle does not use any power. The power for the suction motor, therefore, ranges from the minimum power of 55 Watts (W) to a maximum of 181 W. In the lower half of the chart, from "LOW w/Nozzle" 1006 to "MAX w/Nozzle" 1008, the power for the suction motor ranges from 58 W to 121 W, since from 30 W to 60 W of power is diverted to the powered nozzle.

In operation, if the vacuum cleaner 100 is running in a low power mode to conserve the battery capacity, it may be drawing 55 W with a non-powered nozzle or 58 W with a powered nozzle. If one of the edge sensors detects a wall, the suction motor power is increased to a predetermined level that may be, for example, the maximum. For the non-powered nozzle, this would increase the suction motor power to a maximum of 181 W, while, for the powered nozzle, this would increase the suction motor power to a maximum of 121 W. This would result in a significant increase in cleaning ability for the vacuum cleaner 100. Although this increase in cleaning ability comes at the expense of reducing the battery capacity, it is a temporary increase in power consumption only when the vacuum cleaner 100 is close to a wall. Once the vacuum cleaner 100 is moved away from the wall, the power would decrease to the previously set power level, i.e., 55 W with a non-powered nozzle, or 88 W with a powered nozzle.

Figure 11:
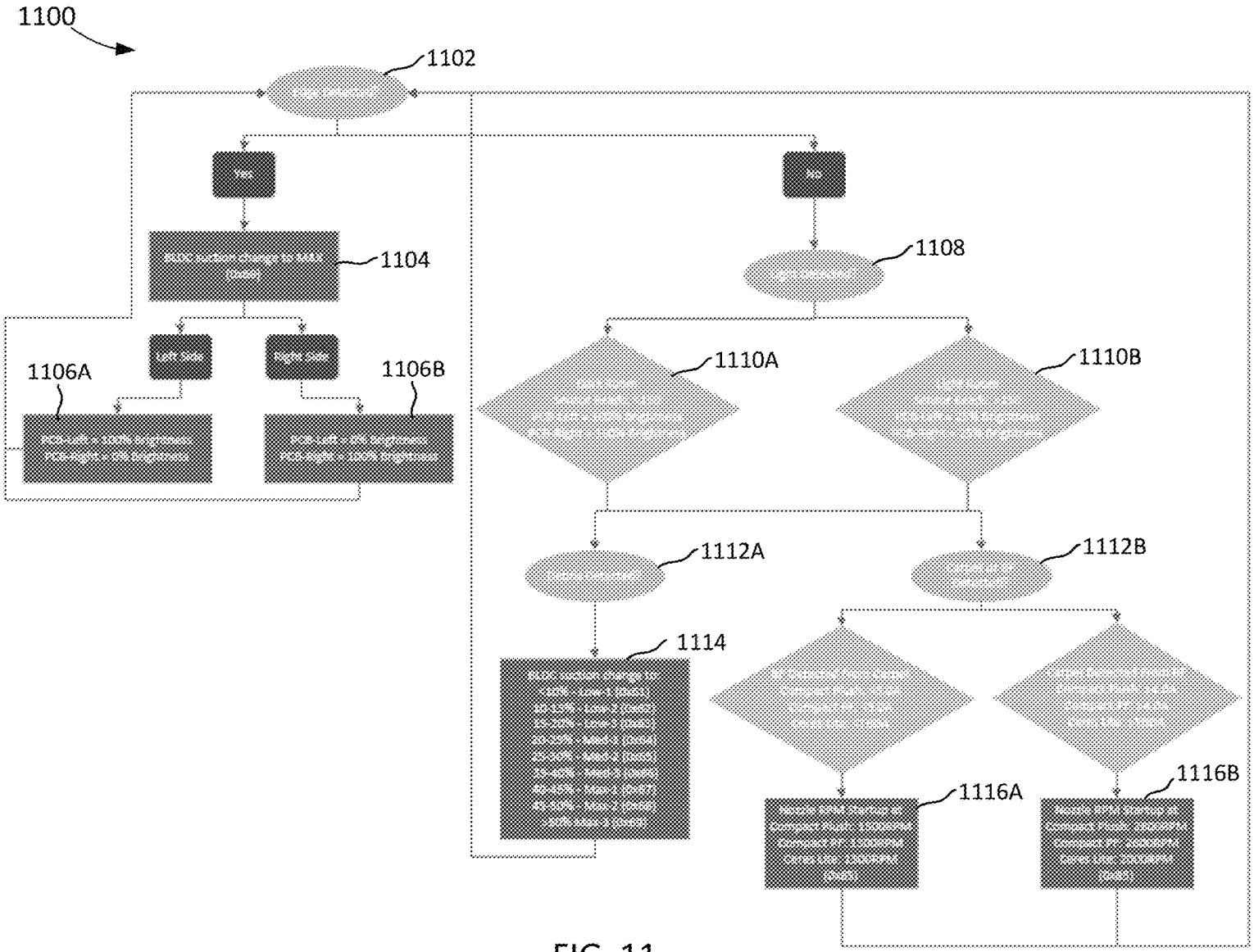
FIG. 11 is a flowchart diagram depicting operations for the controller of the vacuum suction motor power and headlight intensity, for the vacuum of FIGS. 2A-2C, consistent with embodiments of the present disclosure.

FIG. 11 is a flowchart diagram of workflow 1100 depicting operations for the controller of the vacuum suction motor power and headlight intensity, for the vacuum cleaner 100 of FIGS. 2A-2C, consistent with embodiments of the present disclosure. In an alternative embodiment, the operations of workflow 1100 may be performed by any other program while working with workflow 1100.

It should be appreciated that the workflow 1100 of FIG. 11 provides only an illustration of one implementation and does not imply any limitations with regard to the environments in which different embodiments may be implemented. Many modifications to the depicted environment may be made by those skilled in the art without departing from the scope of the disclosure as recited by the claims.

In the illustrated example embodiment, the controller determines if an edge has been detected in decision block 1102. If the controller determines that an edge has been detected ("yes" branch, decision block 1102), then the controller proceeds to operation 1104. If the controller determines that an edge has not been detected ("no" branch, decision block 1102), then the controller proceeds to decision block 1108.

In operation 1104, since the controller has determined that an edge has been detected, the controller increases the suction motor power to maximum. If the controller determines that a left edge was detected, then the controller proceeds to operation 1106A. If the controller determines that a right edge was detected, then the controller proceeds to operation 1106B.

In operation 1106A, since the controller has determined that a left edge has been detected, the controller increases the left section of headlight assembly 700 to a maximum brightness, e.g., 100% brightness, and decreases the right section of headlight assembly 700 to a minimum brightness, e.g., 0% brightness. The controller then returns to decision block 1102.

In operation 1106B, since the controller has determined that a right edge has been detected, the controller increases the right section of headlight assembly 700 to a maximum brightness, e.g., 100% brightness, and decreases the left section of headlight assembly 700 to a minimum brightness, e.g., 0% brightness. The controller then returns to decision block 1102.

In decision block 1108, since the controller determined that an edge has not been detected, the controller determines if light is detected in the room, i.e., that the ambient light level is above a predetermined threshold, e.g., the light is greater than 150 lumens. If the controller determines that light is detected in the room ("yes" branch, decision block 1108), then the controller proceeds to operation 1110B. If the controller determines that light is not detected in the room ("no" branch, decision block 1108), then the controller proceeds to operation 1110A.

In operation 1110A, since the controller has determined that light is not detected in the room, i.e., that the ambient light level is below a predetermined threshold, e.g., the light is less than or equal to 150 lumens, the controller increases both sections of the headlight assembly 700 to maximum brightness, e.g., 100% brightness. The controller then proceeds to decision block 1112A and decision block 1112B.

In operation 1110B, since the controller has determined that light is detected in the room, i.e., that the ambient light level is below a predetermined threshold, e.g., the light is greater than 150 lumens, the controller decreases both sections of the headlight assembly 700 to minimum brightness, e.g., 25% brightness. The controller then proceeds to decision block 1112A and decision block 1112B.

In decision block 1112A, the controller determines if debris is detected in the suction intake. If the controller determines that debris is detected in the suction intake ("yes" branch, decision block 1112A), then the controller proceeds to operation 1114. If the controller determines that debris is not detected in the suction intake ("no" branch, decision block 1112A), then the controller proceeds to decision block 1112B, if the controller has not already processed decision block 1112B, or the controller returns to decision block 1102 if it has already processed decision block 1112B on this cycle.

In decision block 1112B, the controller determines whether carpet or a bare floor is detected. In decision block 1112B, the controller determines if the vacuum cleaner 100 transitioned from carpet to a bare floor. In some embodiments, the controller determines that the vacuum cleaner 100 transitioned from carpet to a bare floor by a decrease in current draw. If the controller determines that the vacuum cleaner 100 transitioned from carpet to a bare floor ("yes" branch, decision block 1112B), then the controller proceeds to operation 1116A.

In some embodiments, the controller determines that the vacuum cleaner 100 transitioned from a bare floor to carpet by an increase in current draw. If the controller determines that the vacuum cleaner 100 did not transition from carpet to a bare floor ("no" branch, decision block 1112B), then the controller proceeds to operation 1116B.

In operation 1114, since the controller has determined that debris is detected in the suction intake, the controller increases the power of the suction motor. For example, the controller may increase the power of the suction motor between a first suction power level that corresponds to a first amount of detected debris, a second power level that corresponds to a second amount of detected debris, and/or a third power level that corresponds to a third amount of detected debris. In some embodiments, the amount of increase in the power to the suction motor varies, for example, proportionate to the amount of debris detected in the air inlet 104. The controller then proceeds to decision block 1112B, if the controller has not already processed decision block 1112B, or the controller returns to decision block 1102 if it has already processed decision block 1112B on this cycle.

In operation 1116A, since the controller has determined that the vacuum cleaner 100 transitioned from carpet to a bare floor, the controller sets the nozzle RPM startup at a first predetermined value for a bare floor. The controller then returns to decision block 1102.

In operation 1116B, since the controller has determined that the vacuum cleaner 100 transitioned from a bare floor to carpet, the controller sets the nozzle RPM startup at a second predetermined value for a carpeted floor. The controller then returns to decision block 1102.

Figure 12:
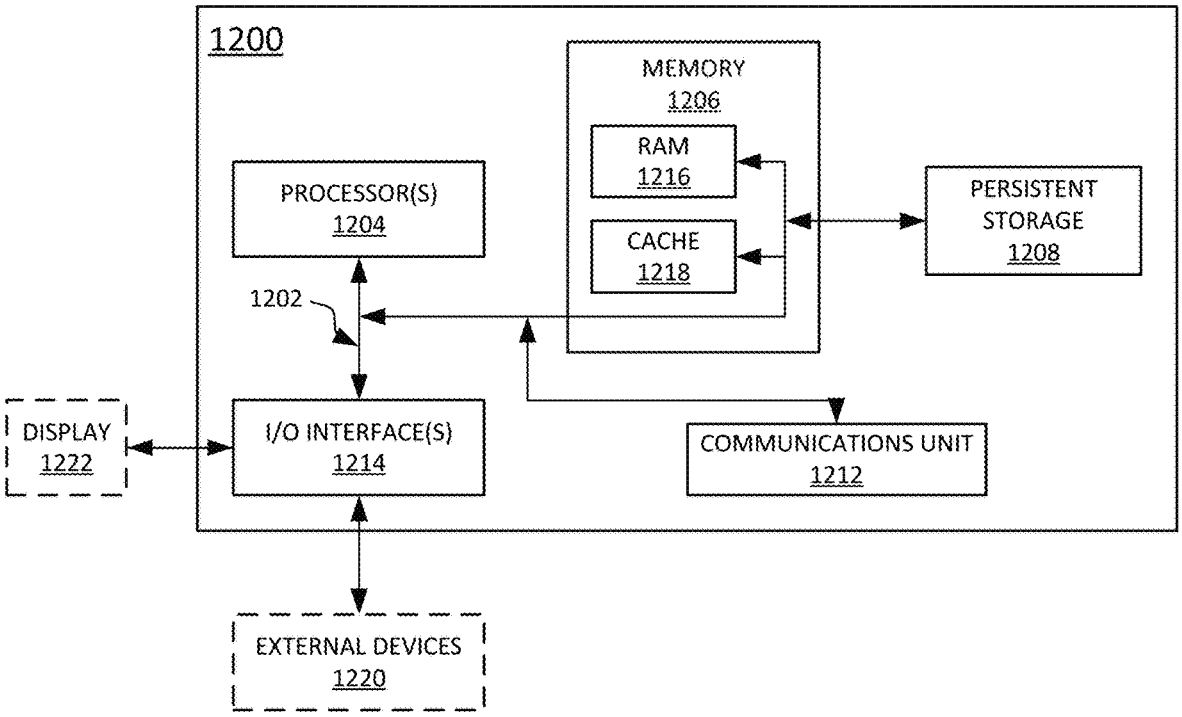
FIG. 12 is a block diagram depicting components of one example computing device suitable for the controller, in accordance with at least one embodiment of the disclosure.

FIG. 12 is a block diagram depicting components of one example of the computing device suitable for the controller, in accordance with at least one embodiment of the disclosure. FIG. 12 displays the computing device or computer 1200, one or more processor(s) 1204 (including one or more computer processors), a communications fabric 1202, a memory 1206 including, a random-access memory (RAM) 1216 and a cache 1218, a persistent storage 1208, a communications unit 1212. I/O interfaces 1214, a display 1222, and external devices 1220. It should be appreciated that FIG. 12 provides only an illustration of one embodiment and does not imply any limitations with regard to the environments in which different embodiments may be implemented. Many modifications to the depicted environment may be made.

As depicted, the computer 1200 operates over the communications fabric 1202, which provides communications between the computer processor(s) 1204, memory 1206, persistent storage 1208, communications unit 1212, and input/output (I/O) interface(s) 1214. The communications fabric 1202 may be implemented with an architecture suitable for passing data or control information between the processors 1204 (e.g., microprocessors, communications processors, and network processors), the memory 1206, the external devices 1220, and any other hardware components within a system. For example, the communications fabric 1202 may be implemented with one or more buses.

The memory 1206 and persistent storage 1208 are computer readable storage media. In the depicted embodiment, the memory 1206 comprises a RAM 1216 and a cache 1218. In general, the memory 1206 can include any suitable volatile or non-volatile computer readable storage media. Cache 1218 is a fast memory that enhances the performance of processor(s) 1204 by holding recently accessed data, and near recently accessed data, from RAM 1216.

Program instructions for the controller may be stored in the persistent storage 1208, or more generally, any computer readable storage media, for execution by one or more of the respective computer processors 1204 via one or more memories of the memory 1206. The persistent storage 1208 may be a magnetic hard disk drive, a solid-state disk drive, a semiconductor storage device, flash memory, read only memory (ROM), electronically erasable programmable read-only memory (EEPROM), or any other computer readable storage media that is capable of storing program instruction or digital information.

The media used by persistent storage 1208 may also be removable. For example, a removable hard drive may be used for persistent storage 1208. Other examples include optical and magnetic disks, thumb drives, and smart cards that are inserted into a drive for transfer onto another computer readable storage medium that is also part of persistent storage 1208.

The communications unit 1212, in these examples, provides for communications with other data processing systems or devices. In these examples, the communications unit 1212 includes one or more network interface cards. The communications unit 1212 may provide communications through the use of either or both physical and wireless communications links. In the context of some embodiments of the present disclosure, the source of the various input data may be physically remote to the computer 1200 such that the input data may be received, and the output similarly transmitted via the communications unit 1212.

The I/O interface(s) 1214 allows for input and output of data with other devices that may be connected to computer 1200. For example, the I/O interface(s) 1214 may provide a connection to external device(s) 1220 such as a keyboard, a keypad, a touch screen, a microphone, a digital camera, and/or some other suitable input device. External device(s) 1220 can also include portable computer readable storage media such as, for example, thumb drives, portable optical or magnetic disks, and memory cards. Software and data used to practice embodiments of the present disclosure can be stored on such portable computer readable storage media and can be loaded onto persistent storage 1208 via the I/O interface(s) 1214. I/O interface(s) 1214 also connect to a display 1222.

Display 1222 provides a mechanism to display data to a user and may be, for example, a computer monitor. Display 1222 can also function as a touchscreen, such as a display of a tablet computer.

According to one aspect of the disclosure, there is thus provided vacuum cleaner, the vacuum cleaner including: an air inlet; a suction motor; one or more edge detect sensors; a headlight assembly; one or more light sensors; and a controller. The controller is configured to: determine whether the vacuum cleaner is within a predetermined distance of a vertical surface based on an input received from the one or more edge detect sensors; responsive to determining that the vacuum cleaner is within the predetermined distance of the vertical surface, increase a suction power of the suction motor to a predetermined value; determine an ambient light level in an environment of the vacuum; and adjust an intensity of the headlight assembly based on the ambient light level in the environment.

According to another aspect of the disclosure, there is thus provided vacuum cleaner, the vacuum cleaner including: a suction motor; one or more edge detect sensors; a headlight assembly; and circuitry, the circuitry configured to: determine whether the vacuum cleaner is within a predetermined distance of a vertical surface based on an input received from the one or more edge detect sensors; responsive to determining that the vacuum cleaner is within the predetermined distance of the vertical surface, increase a suction power of the suction motor to a predetermined value; determine an ambient light level in an environment of the vacuum; and adjust an intensity of the headlight assembly based on the ambient light level in the environment.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

"Circuitry," as used in any embodiment herein, may comprise, for example, singly or in any combination, hardwired circuitry, programmable circuitry such as processors comprising one or more individual instruction processing cores, state machine circuitry, and/or firmware that stores instructions executed by programmable circuitry and/or future computing circuitry including, for example, massive parallelism, analog or quantum computing, hardware embodiments of accelerators such as neural net processors and non-silicon implementations of the above. The circuitry may, collectively or individually, be embodied as circuitry that forms part of a larger system, for example, an integrated circuit (IC), system on-chip (SoC), application-specific integrated circuit (ASIC), programmable logic devices (PLD), digital signal processors (DSP), field programmable gate array (FPGA), logic gates, registers, semiconductor device, chips, microchips, chip sets, etc.

It will be appreciated by those skilled in the art that any block diagrams herein represent conceptual views of illustrative circuitry embodying the principles of the disclosure. Similarly, it will be appreciated that any block diagrams, flow charts, flow diagrams, state transition diagrams, pseudocode, and the like represent various processes which may be substantially represented in computer readable medium and so executed by a computer or processor, whether or not such computer or processor is explicitly shown. Software modules, or simply modules which are implied to be software, may be represented herein as any combination of flowchart elements or other elements indicating performance of process steps and/or textual description. Such modules may be executed by hardware that is expressly or implicitly shown.

The term "coupled" as used herein refers to any connection, coupling, link, or the like by which signals carried by one system element are imparted to the "coupled" element. Such "coupled" devices, or signals and devices, are not necessarily directly connected to one another and may be separated by intermediate components or devices that may manipulate or modify such signals.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto.

What is claimed is:

1. A vacuum cleaner comprising:

an air inlet;

a suction motor;

one or more edge detect sensors;

a headlight assembly;

one or more light sensors; and a controller, the controller configured to:

determine whether the vacuum cleaner is within a predetermined distance of a vertical surface based on an input received from the one or more edge detect sensors;

responsive to determining that the vacuum cleaner is within the predetermined distance of the vertical surface, increase a suction power of the suction motor to a predetermined value;

determine an ambient light level in an environment of the vacuum;

adjust an intensity of the headlight assembly based on the ambient light level in the environment;

determine whether debris is detected in an airflow from the air inlet; and responsive to determining that the debris is detected in the airflow from the air inlet, increase the suction power of the suction motor.

2. The vacuum cleaner of claim 1, the headlight assembly further comprising:

a headlight assembly printed circuit board (PCB);

a plurality of light emitting diodes (LEDs) mounted on the headlight assembly PCB; and a headlight assembly connector, wherein:

the headlight assembly PCB is configured to divide the plurality of LEDs into a first section and a second section; and the first section and the second section are independently controlled.

3. The vacuum cleaner of claim 2, wherein the first section is communicatively coupled to a first edge detect sensor and the second section is communicatively coupled to a second edge detect sensor.

4. The vacuum cleaner of claim 3, the controller further configured to:

responsive to the first edge detect sensor detecting the vertical surface, increase a first output intensity for the first section and decrease a second output intensity for the second section;

responsive to the second edge detect sensor detecting the vertical surface, decrease the first output intensity for the first section and increase the second output intensity for the second section; and responsive to the first edge detect sensor and the second edge detect sensor both detecting the vertical surface, increase the first output intensity for the first section and increase the second output intensity for the second section.

5. The vacuum cleaner of claim 1, the one or more edge detect sensors further comprising:

an edge detector assembly printed circuit board (PCB);

at least one infrared (IR) emitter; and at least one IR receiver, wherein:

the at least one IR emitter is configured to emit a first amount of IR energy; and the at least one IR receiver is configured to detect a second amount of IR energy from the at least one IR emitter that reflects from the vertical surface.

6. The vacuum cleaner of claim 5, wherein determine whether the vacuum cleaner is within the predetermined distance of the vertical surface based on the input received from the one or more edge detect sensors comprises:

transmit the first amount of IR energy from the at least one IR emitter;

determine the second amount of IR energy received by the at least one IR receiver; and responsive to the second amount of IR energy received by the at least one IR receiver exceeding a predetermined threshold, determine that the vacuum cleaner is within the predetermined distance of the vertical surface.

7. The vacuum cleaner of claim 1, the controller further configured to:

monitor a power draw from a nozzle assembly;

determine whether the vacuum cleaner is on a bare floor or a carpeted floor based on the power draw from the nozzle assembly;

responsive to determining that the vacuum cleaner is on the bare floor, adjust the suction motor to a low revolutions per minute (RPM); and responsive to determining that the vacuum cleaner is on the carpeted floor, adjust the suction motor to a high RPM.

8. The vacuum cleaner of claim 1, wherein the one or more edge detect sensors further comprises the one or more light sensors.

9. The vacuum cleaner of claim 1, wherein the suction power of the suction motor is increased based on a third amount of the debris detected in the airflow from the air inlet.

10. A vacuum cleaner comprising:

a suction motor;

one or more edge detect sensors;

a headlight assembly having:

a headlight assembly printed circuit board (PCB);

a plurality of light emitting diodes (LEDs) mounted on the headlight assembly PCB; and a headlight assembly connector, wherein:

the headlight assembly PCB is configured to divide the plurality of LEDs into a first section and a second section; and the first section and the second section are independently controlled; and circuitry, the circuitry configured to:

determine whether the vacuum cleaner is within a predetermined distance of a vertical surface based on an input received from the one or more edge detect sensors;

responsive to determining that the vacuum cleaner is within the predetermined distance of the vertical surface, increase a suction power of the suction motor to a predetermined value;

determine an ambient light level in an environment of the vacuum; and adjust an intensity of the headlight assembly based on the ambient light level in the environment.

11. The vacuum cleaner of claim 10, wherein the first section is communicatively coupled to a first edge detect sensor and the second section is communicatively coupled to a second edge detect sensor.

12. The vacuum cleaner of claim 11, the circuitry further configured to:

responsive to the first edge detect sensor detecting the vertical surface, increase a first output intensity for the first section and decrease a second output intensity for the second section;

responsive to the second edge detect sensor detecting the vertical surface, decrease the first output intensity for the first section and increase the second output intensity for the second section; and responsive to the first edge detect sensor and the second edge detect sensor both detecting the vertical surface, increase the first output intensity for the first section and increase the second output intensity for the second section.

13. The vacuum cleaner of claim 10, the one or more edge detect sensors further comprising:

an edge detector assembly printed circuit board (PCB);

at least one infrared (IR) emitter; and at least one IR receiver, wherein:

the at least one IR emitter is configured to emit a first amount of IR energy; and the at least one IR receiver is configured to detect a second amount of IR energy from the at least one IR emitter that reflects from the vertical surface.

14. The vacuum cleaner of claim 13, wherein determine whether the vacuum cleaner is within the predetermined distance of the vertical surface based on the input received from the one or more edge detect sensors comprises:

transmit the first amount of IR energy from the at least one IR emitter;

determine the second amount of IR energy received by the at least one IR receiver; and responsive to the second amount of IR energy received by the at least one IR receiver exceeding a predetermined threshold, determine that the vacuum cleaner is within the predetermined distance of the vertical surface.

15. The vacuum cleaner of claim 10, the circuitry further configured to:

monitor a power draw from a nozzle assembly;

determine whether the vacuum cleaner is on a bare floor or a carpeted floor based on the power draw from the nozzle assembly;

responsive to determining that the vacuum cleaner is on the bare floor, adjust the suction motor to a low revolutions per minute (RPM); and responsive to determining that the vacuum cleaner is on the carpeted floor, adjust the suction motor to a high RPM.

16. The vacuum cleaner of claim 10, wherein the one or more edge detect sensors are further configured as light sensors.

17. The vacuum cleaner of claim 10, the circuitry further configured to:

determine whether debris is detected in an airflow from an air inlet; and responsive to determining that the debris is detected in the airflow from the air inlet, increase the suction power of the suction motor.

18. The vacuum cleaner of claim 17, wherein the suction power of the suction motor is increased based on a third amount of the debris detected in the airflow from the air inlet.

19. A vacuum cleaner comprising:

a suction motor;

a first edge detect sensor;

a second edge detect sensor;

a headlight assembly having a first section of light emitting diodes (LEDs) and a second section of LEDs, the first and second sections of LEDs being independently controllable; and circuitry configured to:

determine whether the vacuum cleaner is within a predetermined distance of a vertical surface based on an input received from the first or second edge detect sensor;

responsive to determining that the vacuum cleaner is within the predetermined distance of the vertical surface, increase a suction power of the suction motor to a predetermined value;

responsive to the first edge detect sensor detecting the vertical surface, increase a first output intensity for the first section of LEDs and decrease a second output intensity for the second section of LEDs; and responsive to the second edge detect sensor detecting the vertical surface, decrease the first output intensity for the first section of LEDs and increase the second output intensity for the second section of LEDs.

20. The vacuum cleaner of claim 19 further comprising an agitator, wherein the circuitry is further configured to:

determine whether the vacuum cleaner is on a bare floor or a carpeted floor;

responsive to determining that the vacuum cleaner is on the bare floor, cause the agitator to rotate at a first rotation speed; and responsive to determining that the vacuum cleaner is on the carpeted floor, cause the agitator to rotate at a second rotation speed, the second rotation speed being different from the first rotation speed.

* * * * *